United States Patent [19]

Shihabi

[11] 4,377,469

[45] Mar. 22, 1983

[54] MAINTAINING CATALYTIC ACTIVITY OF SODIUM ALUMINOSILICATES

[75] Inventor: David S. Shihabi, Pennington, N.J.

[73] Assignee: Mobil Oil Corporation, New York, N.Y.

[21] Appl. No.: 307,055

[22] Filed: Sep. 30, 1981

[51] Int. Cl.[3] ..... C10G 11/05; C10G 47/16

[52] U.S. Cl. ..... 208/111; 208/120

[58] Field of Search ..... 208/111, 120

[56] References Cited

U.S. PATENT DOCUMENTS 4,149,960 4/1979 Garwood et al. ..... 208/111

4,315,814 1/1981 Shihabi ..... 208/111

OTHER PUBLICATIONS

John W. Ward, "The Nature of Active Sites on Zeolites", IV, The Influence of Water, J. Catalysis 11, 238–250, (1968).

T. Y. Yan, "The Promotional Effect of Water in Hydrocracking", J. Catalysis 25, 204–211, (1972).

Minachev et al., Soviet Scientific Reviews, Section B, Chemistry Reviews, vol. 2, (1980).

*Primary Examiner*—Delbert E. Gantz

*Assistant Examiner*—G. E. Schmitkons

*Attorney, Agent, or Firm*—Charles A. Huggett; Michael G. Gilman; Charles J. Speciale

[57] ABSTRACT

The aging of a dewaxing catalyst, such as a presteamed, sodium-exchanged ZSM-5 type zeolite, is improved when the dewaxing is being conducted in the presence or absence of added gas if water or a water precursor is admixed with the feedstock.

13 Claims, 4 Drawing Figures

MAINTAINING CATALYTIC ACTIVITY OF SODIUM ALUMINOSILICATES

CROSS-REFERENCE TO RELATED APPLICATION

The application is related to application Ser. No. 103,793, filed Dec. 14, 1979.

BACKGROUND OF THE INVENTION

1. Field of the Invention

The invention relates to a catalytic process for the conversion of mineral oils. More particularly it relates to improving the life and/or lowering the deactivation rate of crystalline aluminosilicate catalysts without adversely affecting their stability. This invention especially relates to improved means for reducing the pour point of mineral oil streams by controlling the rate of aging of a crystalline aluminosilicate catalyst by the addition of materials, such as water, to the reaction zone.

2. Description of the Prior Art

It is well known in the petroleum refining art to improve the quality of various hydrocarbon oils by treating them with catalysts under varying conversion conditions to effect such reactions as cracking, hydrocracking, hydrofining, isomerization, dewaxing, and the like. In these processes, operating catalyst life usually depends on the nature of feedstock, the severity of the operation and often, on the nature and the extent of operational upsets. Gradual catalyst deactivation is countered by incrementally raising the operating temperature to maintain the required conversion.

Numerous investigators have demonstrated that the activity of silica-alumina and clays used in various acid-type catalytic reactions depends in part on the degree of hydration of the surface. The effect of water on hydrocracking was reported by T. Y. Yan [see *J. Catalysis* 25, 204–211 (1972)]. Yan evaluated the addition of water, introduced as 2-pentanol or water vapor, on the hydrocracking activities of palladium impregnated rare earth exchanged zeolite X and a platinum impregnated zeolite HY. The addition of 3 wt % 2-pentanol to the feed or saturating the feed with water vapor at 75% reduced the temperature required for a 60% conversion of n-hexadecane by 12° F. Yan further showed that the activation was due to water and not by the pentene produced by the dehydration of 2-pentanol. The promotional effect of water on the hydroprocessing of a commercial feedstock was found to be minimal. Furthermore, water failed to promote zeolite HY. K. H. M. Minachev and Ya. I. Isakov have reported in *Soviet Scientific Reviews,* Section B. Chemistry Reviews, Vol. 2 (1980) that sodium forms of zeolites are not promoted by water. In addition, John W. Ward (*J. Catalysis,* 11, 238–250 (1968) studies the influence of small amounts of water on the acidity of several alkali, alkaline earth, hydrogen and mixed cation zeolites by observing changes in the infrared spectrum of chemisorbed pyridine. Water had no marked effect on the acidity of alkali cation X and Y zeolites.

Water and water precursors have also been disclosed in the patent art as useful in enhancing catalytically promoted petroleum processes. Water has been disclosed as enhancing the activity of metal catalysts supported on inorganic metal oxide supports in such processes as reforming (U.S. Pat. Nos. 2,642,383 of Berger et al and 3,649,524 of Derr et al.); hydrodesulfurization (U.S. Pat. No. 3,720,602 of Riley et al); dehydrogenation (U.S. Pat. No. 3,907,921 of Winter) and hydrocracking (U.S. Pat. No. 4,097,364 of Egan). In addition, water has been found useful in petroleum processing in promoting the activity of crystalline aluminosilicates, such as zeolite X and Y (U.S. Pat. Nos. 3,493,490 of Plank et al (cracking); 3,546,100 of Yan (hydrocracking) and 4,097,364 of Egan (hydrocracking)) and ZSM-5 (U.S. Pat. No. 4,149,960 of Garwood et al (dewaxing)). Garwood et al disclosed that dewaxing of gas oils with a ZSM-5 type zeolite in hydrogen form is enhanced by cofeeding water with gas oil feed. The benefits obtained are improvements in coke lay-down and catalyst aging rates. There is no suggestion that a sodium exchanged ZSM-5 type zeolite has catalytic dewaxing capability or that the presence of water would benefit such a zeolite.

In some particular petroleum conversion processes involving cracking, a certain class of compounds in a feedstock may be converted to modify a characteristic of the whole feedstock. Exemplary of the latter type of conversion is catalytic hydrodewaxing whose principle purpose is to reduce the pour point of wax containing mineral oils. Pour point is the temperature at which an oil will not flow, as determined by standardized test procedures. The waxy compounds are long carbon chain molecules which tend to crystallize on cooling of the oil to an extent such that it will not flow, hence it may not be pumped or transported by pipelines at ambient temperatures.

Catalytic dewaxing as practiced today involves the shape selective conversion of straight and slightly branched aliphatic compounds of 12 or more carbon atoms, viz., the waxy molecule, to reduce the pour point, pumpability and/or viscosity of mineral oil fractions which contain these waxy constituents.

Particularly effective catalysts for catalytic dewaxing include zeolite ZSM-5 and related porous crystalline aluminosilicates as described in U.S. Pat. No. Re. 28,398 of Chen et al. As described in that patent, drastic reductions in pour point are achieved by catalytic shape selective conversion of the wax content of heavy stocks with hydrogen in the presence of a dual-functional catalyst of a metal plus the hydrogen form of ZSM-5. The conversion of waxes is by scission of carbon to carbon bonds (cracking) and production of products of lower boiling point than the waxes. However, only minor conversion occurs in dewaxing. For example, Chen et al. describe hydrowaxing of a full range shale oil having a pour point of +80° F. to yield a pumpable product of pour point at −15° F. The shift of materials from the function heavier than light fuel oil to lighter components was in the neighborhood of 9% conversion.

Among the less specialized techniques for producing products of lower molecular weight than the hydrocarbon charge stock are catalytic cracking and catalytic hydrocracking. Catalytic cracking involves contacting the heavy hydrocarbon charge with a porous acidic solid catalyst at elevated temperatures in the range of 850° to 1000° F. to yield the desired lower boiling liquid product of greater value than the liquid charge (e.g. motor gasoline) together with normally gaseous hydrocarbons and coke as byproducts. Hydrocracking employs a porous acidic catalyst similar to that used in the catalytic cracking but associated with a hydrogenation component such as metals of Groups VI and VIII of the Periodic Table. An excess of hydrogen is supplied to the hydrocracking reactor under superatmospheric pressure at lower temperatures than those characteristic of catalytic cracking, say about 650° F.

Since the introduction of zeolite catalysts as exemplified by U.S. Pat. No. 3,140,249, a large proportion of the capacity for catalytic cracking and hydrocracking has been converted to use of such highly active catalysts. The high activity zeolite catalysts are characterized by very low content of alkali metal. Sodium, for example, is present as a cation in synthetic faujasites by reason of their manufacture. Expensive ion exchange operations are carried out in the preparation of cracking and hydrocracking catalysts from synthetic faujasite to replace the sodium or other alkali metal by protons or poly-valent metal cations, especially rare earth metal cations.

It has been recognized that such zeolites can function as catalysts when containing a moderate percentage of sodium. Thus, U.S. Reissue Patent No. 26,188 of Kimberlin et al. exhibits data showing cracking activity of a faujasite from which only one-third of the sodium has been removed by ion exchange. The extremely high activity of such catalysts as zeolite ZSM-5 has been moderated for specialized purposes by using the zeolite in the partially sodium form. See, for example, U.S. Pat. No. 3,899,544.

Zeolite ZSM-5 preparation is described in U.S. Pat. No. 3,702,886 which also describes several processes in which the zeolite is an effective catalyst, including cracking and hydrocracking. That zeolite is shown to be prepared from a forming solution which contains organic cations, namely alkyl substituted ammonium cations. Those large organic cations then occupy cationic sites of the zeolite and block pores at least partially. The conventional method for removing the organic cations is to burn them out with air at elevated temperature, leaving a proton at the site previously occupied by the organic cation. Sodium, or other alkali metal, at other cationic sites may then be ion exchanged to provide protons or multivalent metals as desired to prepare catalysts for cracking, hydrocracking and other purposes.

The alpha value of a zeolite catalyst is a measure of the activity of the catalyst to cracking hexane. The test procedure to determine the alpha value is described in *Journal of Catalysis,* Vol VI, pp. 278–287 (1966). Zeolites, such have the ZSM-5 type, have a structure which provides constrained access to larger molecules. The existance of this type of structure may be evaluated on a constraint index scale which approximates the ratio of the cracking rate constants for hexane and 3-methylpentane when a mixture of these hydrocarbons is subjected to cracking with the zeolite. This constraint index test procedure is described in *Journal of Catalysis,* Vol. 67, pp 218–222 (1981).

Commonly assigned U.S. patent application Ser. No. 103,793 filed Dec. 14, 1979 discloses improvements in pour point reduction by means of catalytic dewaxing employing a catalyst prepared from a ZSM-5 type zeolite having a constraint index of about 1 to about 12. This dewaxing process employs a low acidity form of zeolite such as ZSM-5 or ZSM-11 in which the low acidity is imparted by steaming the zeolite to reduce its cracking activity to an alpha value of not less than about 5, followed by base ion exchange with an alkali metal cation to reduce the alpha value to not greater than 1.0. A preferred catalyst is referred to therein as a presteamed Na ZSM-5 and is employed to dewax crude oils and other waxy feedstocks in the presence of added hydrogen. These catalysts are effective at start-of-run temperature of about 640° F. and exhibit excellent aging behavior in the presence of hydrogen. However, in the absence of hydrogen these catalysts exhibit a gradual aging requiring a daily increase of about 1°–10° F. in the reaction temperature. Dewaxing processes conducted with presteamed sodium ZSM-5 in the absence of hydrogen exhibit, on the average, cycle times of several weeks between catalyst regenerations because of catalyst aging.

The presteamed base exchanged catalyst disclosed in application Ser. No. 103,793 is particularly suited to reducing the pour point of waxy crude oils. This catalyst is especially resistant to the metals, nitrogen and sulfur often associated with crude oils and it does not cause the formation of appreciable quantities of $C_3$-gaseous products so that the liquid recovery from crude dewaxing is often 98% or better. Ideally, crude oil dewaxing should be practiced at the wellhead so as to permit easy transporting of the dewaxed crude by pipeline. Where an economical source of hydrogen is available, the above described process is commercially feasible. However, practicing this process without a source of hydrogen could be economically attractive if the cycle times between catalyst regenerations are sufficiently long.

It is an object of this invention to provide a process for reducing the pour point of waxy mineral oil.

It is another object of this invention to provide a process of catalytic dewaxing in the presence or absence of hydrogen.

It is a further object of this invention to provide a process of catalytic dewaxing with a presteamed sodium-exchanged ZSM-5 type zeolite in the presence or absence of added gas having a prolonged cycle time.

SUMMARY OF THE INVENTION

These and other objects are achieved by cofeeding water or a water precursor to a dewaxing process employing a presteamed Na ZSM-5 catalyst. Briefly, this invention is an improvement over the particular embodiment of application Ser. No. 103,793 which employs a low acidity catalyst prepared by steaming followed by base exchange whereby the dewaxing is conducted in the presence or absence of added gas but with water or a water precursor being co-feed to the reactor.

In particular, this invention concerns a process for reducing the pour point of a wax containing mineral oil to a predetermined value which comprises:

contacting a mixture of said mineral oil and added water or a water precursor with a catalyst having an alpha value less than about 10, in the presence or absence of added gas, under conversion conditions effective to reduce the pour point of said oil to said predetermined value, said catalyst having been prepared from a composition comprising a precursor crystalline aluminosilicate having a silica-alumina ratio greater than 12, a constraint index between about 1 and about 12 and an alpha value greater than about 20, said preparation including steaming said precursor to reduce its alpha value do not less than about 10 and ion-exchanging said steamed precursor with an alkali metal cation under conditions effective to further reduce its alpha value to less than about 10, said water or said water precursor being present in an amount effective to reduce the conversion temperature required to effect the reduction of the pour point of said mineral oil to said predetermined value in the absence of said water or said water precursor.

DESCRIPTION OF THE PREPARED EMBODIMENTS

Figure 1:
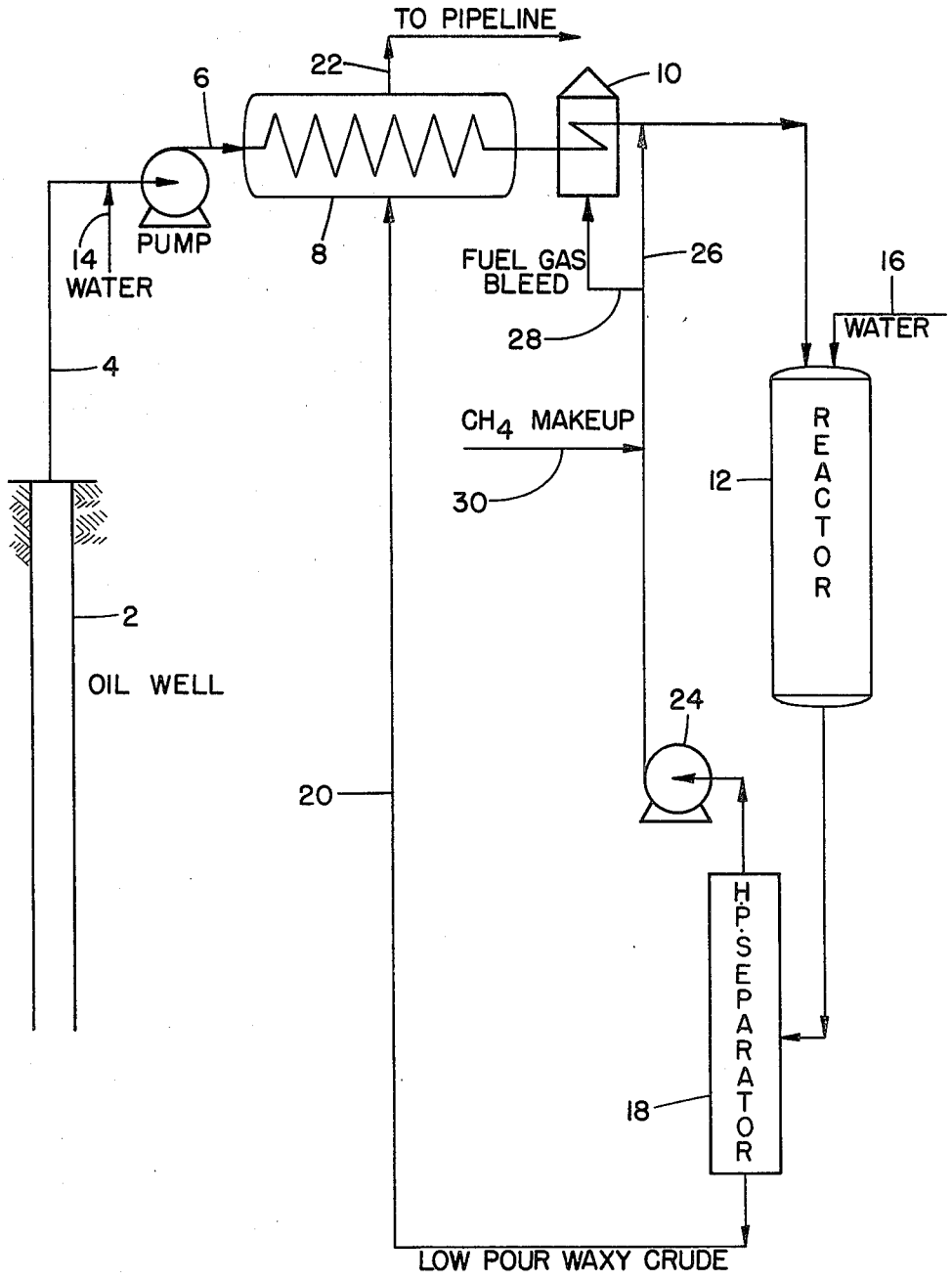
FIG. 1 is a schematic flowplan of an embodiment of the invention.

The present invention relates to a process of reducing the pour point of a waxy mineral oil whereby it may be readily pumped at ambient temperatures. Briefly, this invention is an improvement over a particular dewaxing embodiment disclosed in application Ser. No. 103,793, whereby the dewaxing was conducted with a presteamed sodium exchanged ZSM-5 in the presence of hydrogen to achieve commercially acceptable cycle times between catalyst regenerations.

In accordance with the present invention the cycle time for the dewaxing of a waxy mineral oil change conducted in the presence or absence of added gas when employing a catalyst in which the active cracking ingredient is a low acidity form of a zeolite having a silica:alumina ratio above 12 and a constraint index of between about 1 and 12 is significantly improved by injecting water or a water precursor into the reaction zone. The low acidity is imparted to the zeolite, such as zeolite ZSM-5, by steaming followed by base exchange with an alkali metal cation under conditions to significantly reduce hexane cracking activity, as described in application Ser. No. 103,793, the entire contents of which are incorporated herein by reference.

Application Ser. No. 103,793 includes an embodiment of preparing a useful dewaxing catalyst having an alpha value not greater than about 1.0 by steaming a catalyst comprising a precursor crystalline zeolite characterized by a silica/alumina ratio greater than 12, a constraint index between about 1 and about 12 and an alpha value greater than about 20 to reduce its alpha value to not less than about 5 and ion-exchanging the steamed precursor with an alkali metal cation to reduce its alpha value to not greater than about 1.0.

In practicing the process of this invention it has been found that the catalyst preparation is preferably described as steaming the precursor to an alpha value not less than about 10 and ion-exchanging the steamed precursor to further reduce its alpha value, i.e., to less than about 10, preferably to less than about 1.

The catalyst used in the present invention is a low acidity form of a class of zeolites which have been found to be extremely active in the acid form. In that form the cationic sites are occupied by protons introduced by ion exchange with an acid or an ammonium (including substitued ammonium) cation which is then decomposed by heat to a proton. Altenatively at least a portion of the cationic sites may be occupied by polyvalent metals. For use in the present invention, these very high acidities inherent in zeolites, such as zeolite ZSM-5, are drastically reduced. Preferably, the acidity is reduced by extensive ion exchange with sodium or other alkali metal. The invention may also be practiced with such zeolites of very high silica/alumina ratio or by steaming of the active form of the zeolite. It will be recognized by those skilled in the art of zeolite catalysis that substitution of sodium or like cation and steaming are generally recognized as means to "poison" a zeolite catalyst by severely impairing its activity. These agencies are generally avoided in preparation and use of zeolite catalysts in cracking or hydrocracking.

The acid activity of zeolite catalysts is conveniently defined by the alpha scale described in an article published in *Journal of Catalysis,* Vol. VI, pp 278–287 (1966). In this test, the zeolite catalyst is contacted with hexane under conditions prescribed in the publication and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value of less than about 10 and preferably less than about 1 will be considered to have substantially little activity for cracking n-hexane.

In a particular embodiment of this invention, a zeolite having the above described characteristics and an alpha value greater than about 20 is converted to a low acidity catalyst by contact with steam at a temperature of about 700° to about 1200° F. for a period of time effective to reduce its alpha value to not less than about 10. In general, it is contemplated to reduce the alpha value by steam treatment by at least about 10 alpha units. Contacting with steam may be conducted at atmospheric pressure with saturated steam, but superheated steam, subatmospheric pressure, or pressure up to 500 pounds of steam per square inch may be used. The zeolite steamed in accordance with the foregoing procedure is then base exchanged with alkali metal cations to an extent effective to reduce its alpha value to less than about 10 and preferably to less than about 1. In essence, base exchange is conducted under conditions which substantially eliminate the activity of the zeolite for cracking n-hexane although a catalyst with a alpha value even below 0.1 can have some residual activity for n-hexane cracking. However, this residual activity is so small compared with the more highly acidic forms of the same catalyst as to warrant the characterization "substantially eliminated." Alkali metal cations, preferably lithium and sodium, are particularly effective for this purpose. Catalysts prepared by the particular procedure just described are highly efficient for dewaxing, and especially for dewaxing crude oils. In such service, the catalyst is effective at start-of-run temperatures of about 640° F. or even less, and exhibit excellent aging behavior and, as a consequence, long cycle life.

The shape selective catalysis of zeolites is defined by the constraint index scale described in an article published in *Journal of Catalysis,* Vol. 67, pp 218–222 (1981). In this test, the zeolite catalyst is contacted with a mixture of hexane and 3-methylpentane under conditions set forth in the publication and the amount of hexane and 3-methylpentane cracked is measured. From this measurement a constraint index value is computed which is related to the ability of the zeolite for shape selective catalysis. The entire article above referred to is incorporated herein by reference. The constraint index scale so described will be used herein to describe the ability of zeolites for shape selective catalysis.

In general, the catalysts used in accordance with this invention are crystalline zeolites having a silica/alumina ratio greater than 12 and a Constraint Index (C.I.) between about 1 and about 12. The zeolites are generally termed ZSM-5 type zeolites. These zeolites and their use as dewaxing catalysts are described in U.S. Pat. No. 4,149,960 and application Ser. No. 103,793. The entire contents of both are incorporated herein by reference.

The preferred class of zeolites defined herein are ZSM-5 type zeolites as exemplified by ZSM-5, ZSM-11, ZSM-12, ZSM-35, ZSM-38, with ZSM-5 being particularly preferred.

ZSM-5 is more particularly described in U.S. Pat. No. 3,702,886, the entire contents of which are incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

The zeolites used according to the invention have low alpha values, less than about 10. Preferably, the alpha value is substantially lower than unity. As noted, the low acid activity may be achieved by using zeolites of very high silica/alumina ratio or by severe high temperature steaming of zeolites having lower silica/alumina ratio, for example zeolite ZSM-5 of ratio 40 may be treated with 100% steam at 1200° F. for a period of time (several hours) adequate to reduce the acid activity to the necessary level.

Preferably, the low acidity is achieved by extensive ion exchange of the zeolite with sodium or other alkali metal cation. Silica/alumina ratios in the range of 12 to aluminum free will generally characterize the zeolites preferred in this form of the invention. Particularly preferred zeolites may be in range of 20–2000. It is found that the sodium forms of the zeolites usually are less efficient for dewaxing than are the acid forms but give better overall results measured as conversion, particularly since the conversion products are low in gaseous hydrocarbons. In the embodiment of this invention wherein steaming is combined with base exchange, i.e. by steaming to reduce the alpha value by at least 10 units but not below an alpha value of 10 followed by base exchange with an alkali metal under conditions effective to substantially reduce hexane cracking activity, the zeolite catalyst has high activity for dewaxing as measured by its effectiveness at temperatures in the range of about 650° to about 800° F.

Sodium content of the zeolites will vary inversely with the silica/alumina ratio since it is the aluminum atoms which provide cationic sites suitable for acceptance of the alkali metal ion. In the embodiment in which steaming is followed by base exchange, the lattice alumina content will to some extent have been modified and the final sodium content may be somewhat reduced.

In preferred forms of the invention, the zeolite contains no hydrogenation metal component. Therefore, dewaxing processors can be carried out in the presence or absence of added gas. Thus the preferred catalyst is a presteamed, sodium exchanged ZSM-5 zeolite. These low acidity alkali metal zeolites are prepared by ion exchange of the zeolite with an aqueous solution of an alkali metal salt or hydroxide at moderate pH values. In the following examples, care was taken to assure nearly complete ion exchange. Thus the observed activity appears truly representative of low acidity zeolites.

The improvements of this invention are achieved by injecting water or water precursor into the reaction zone. Although water is preferably employed in this invention, materials, known as water precursors may also be employed. The water precursor should be a material which will convert to and form water under the reaction conditions employed for dewaxing, such as 2-pentanol and the like. 2-Pentanol easily converts to pentene and water. The water or the precursor can be injected in either liquid or gaseous form and can be supplied directly to the dewaxing reactor or combined with the feed. The addition can be made in a pulsed fashion or continously. One convenient means is to supply the water or precursor for a prolonged period of time, say, for 8–10 hours while monitoring the reaction temperature necessary to maintain the desired pour point in the product. Conventionally, the addition will permit a reduction in the reaction temperature. Those skilled in the art can determine without an undue amount of experimentation the length of time for the water or precursor addition so as to limit the reduction in the reaction temperature to the desired lower temperature, e.g., the temperature at the beginning of the cycle. When periodic additions of water are employed, it has been found that about 0.01 to about 30 volumes of water/volume of catalyst are effective for prolonging the catalyst life. These water additions may be continued for 6–24 hours or longer. Effective amounts of water precursors will, of course, be dependent on the particular material employed and the amount of water the selected processor produces. The skilled artisan can readily determine the required amounts of a particular precursor based on the results obtained with liquid water or steam additions. It is also possible to continuously add water or a water precursor to the feed or the reactor in a fashion which will substantially maintain the start-of-cycle reaction temperature for a prolonged portion of the cycle. Continuous water additions of below about 5 volume percent of the feed have been found useful.

Although the process of the invention may be practiced in the absence of added gas, it is preferred that gas be added to the process. Such gases as hydrogen, $C_1$–$C_3$ hydrocarbons or mixtures thereof may be employed. Therefore, gaseous hydrocarbons, such as methane, associated with crude oil may be employed.

In on-site whole crude upgrading the process must be conducted in the presence of methane which may be supplied per se or provided as part of the gaseous hydrocarbons existing in the downhole formation with the crude oil and which are produced together with the crude oil at the well head. When operated in this fashion, i.e. under methane pressure, it is preferred to operate by the trickle technique with methane flowing concurrently downward with mixed vapor and liquid phase hydrocarbons.

Temperature of the reaction is between 600° F. and 850° F. depending on the feed. However, with the particular catalyst utilized herein which is prepared by steaming to an alpha value of not less than 10 followed by base exchange with alkali, satisfactory activity has been found at temperatures less than 700° F. Many charge stocks will undergo some thermal cracking at temperatures above about 800° F. with resultant production of undesired gaseous hydrocarbons thereby losing one advantage of the invention to the extent that thermal cracking takes place.

Pressures employed will vary according to the technique being used. For liquid full reactor operation, the minimum pressure will be that necessary to maintain the charge in liquid phase at the temperature of reaction. In any event, the pressure will be above about 200 psi. There appears to be no maximum pressure limit imposed by effectiveness of the catalyst, but costs for capital installation and operation of compressors and the like rise rapidly for pressures in excess of 2000 psi. When methane or hydrogen or any gas is added to the system, it is preferred to operate below that level for economic reasons. Gas circulation may be maintained at from 0 to 15,000 scf/bbl.

Space velocity will vary somewhat with the type of feed, permitting a higher space velocity for a feedstock which is easily dewaxed.

In general, space velocity will range from about 0.1 liquid volume of hydrocarbon charge per volume of catalyst per hour (LHSV) up to about 5.0 LHSV. For most charge stocks, preferable LHSV will range from about 0.3 to about 1.0.

Crude oils of high pour point are not suited to pipeline transportation because they cannot be pumped and will not flow in pipes at temperatures below the pour point which may be 50° F. or higher. As shown by FIG. 1, one preferred use of the present invention is for the conversion of waxy crude petroleum in the field to provide a product suitable for transmission by pipeline. The present invention may be practiced in relatively simple processing equipment which can be transported to and operated at remote sites. Since the catalyst contains no hydrogenation components the present process may be practiced in the absence of hydrogen. If desired, methane which is often available in the oil fields with other light gases may be used as a circulating gas. Since this improved process can be operated in the absence of hydrogen its utility at remote oil fields is greatly enhanced over other pour reduction techniques. Thus this invention can be practiced by processing the crude oil as it is produced at the well head, in mixed gaseous-liquid form.

Waxy crude oils are generally high in hydrogen and low in sulfur and metal contaminants. However, these desirable characteristics are at present counterbalanced by the transportation problems associated with the high pour point of the crude. The present invention solves the transportation problem at a reasonably low cost and therefore leads to wider distribution of waxy crude oils around the world.

The embodiment shown in FIG. 1 utilizes a presteamed alkali metal exchanged ZSM-5, such as NaZSM-5, in a simple reactor system installed near the producing well to convert heavy waxy crude oil to pipelineable crude.

The catalyst is unique in its resistance to metals, nitrogen and other catalyst poisons and can be used in the presence or absence of hydrogen. In addition, water cofeeding will further lengthen cycle times.

Referring now to FIG. 1, waxy petroleum together with gaseous hydrocarbons from producing well 2 passes at formation temperatures by line 4 to pump 6 which discharges to the tubes of heat exchanger 8 to be preheated by exchange against the product of the process. The preheated waxy crude passes from heat exchanger 8 to furnace 10 where it is heated further to a temperature suitable for the desired conversion. The heated charge is introduced to reactor 12 for conversion in the presence of a presteamed sodium exchanged zeolite catalyst, such as a presteamed Na ZSM-5, under conditions described heretofore. It will be noted that the conversion in this embodiment takes place without added hydrogen, a material difficult to provide at field installations. Water is injected into the system at a convenient point. For example, it can be supplied through line 14 for admixture with the crude in the suction line to pump 6 or through line 16 directly into reactor 12.

Products of the reaction, constituted by low pour point crude with a small amount of gaseous hydrocarbons, are transferred to a high pressure separator 18 from which the low pour point liquid product of the conversion in reactor 12 is transferred by line 20 to the shell side of heat exchanger 8 where it is cooled by supplying preheat to the incoming charge as above described. The cooled product flowing through line 22 from the shell side of heat exchanger 8 is a low pour point liquid petroleum suitable for transport by pipeline. Gaseous hydrocarbons of 1–4 carbon atoms are withdrawn from separator 18 and pass through compressor 24 for recycle by line 26 to the heated feed leaving furnace 10. Where additional methane is required in the process it may be provided to the recycle gas stream through line 30.

The following examples illustrate the practice of this invention.

EXAMPLE I

A presteamed sodium form of ZSM-5 was prepared as follows:

The ammonium form of ZSM-5 extrudate was contacted with 100% steam at 850° F. for 16 hours. The steam treated product was added to 1 N $NH_4NO_3$ solution, pH 4. The mixture was maintained at 200° F. for 4 hours with continuous stirring, then the liquid was decanted and the catalyst was washed with de-ionized water. The resulting catalyst was then Na-exchanged (pH of exchange 8–9) to an alpha value of 0.3 by adding 1.0 gram of the treated extrudate (now in the ammonium form) to 60 ml of 0.3 N Na $HCO_3$ solution having a pH of 8.5. The mixture was maintained at room temperature for 3 hours with occasional agitation by swirling or stirring. The liquid was then decanted and replaced with 60 ml. of fresh 0.3 N Na $HCO_3$ solution. The sodium exchange was completed in an additional 3 hours. The recovered Na ZSM-5 was washed with copious quantities of deionized water (adjusted to a pH of 8–9 with NaOH) and dried at 130° C.

Figure 2:
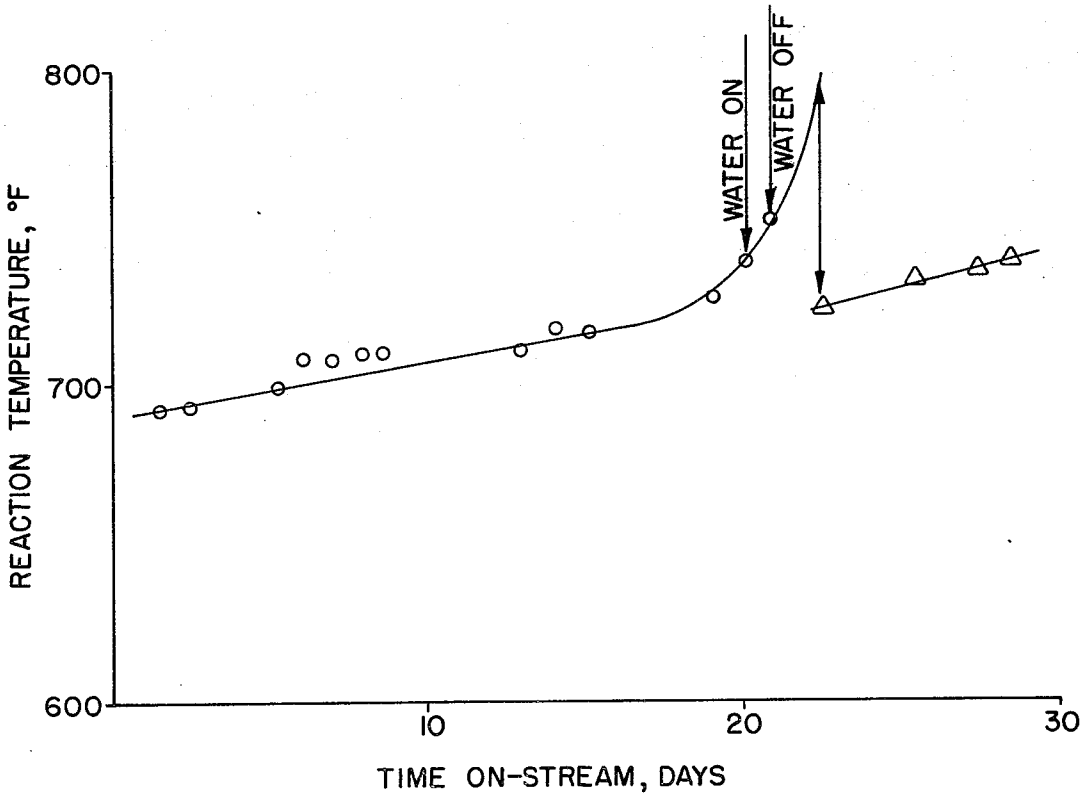
FIG. 2 is a graph showing the effect of water injection on reaction temperature when dewaxing Altamount whole crude with presteamed Na ZSM-5 catalyst in the absence of added gas.

Altamont crude was processed over the recovered catalyst at 650°–740° F., 1 LHSV and in the absence of added gas. A continuous run was made with the Altamont crude oil over the presteamed NaZSM-5 extrudate for 28 days. After 20 days water was cofed at a rate of 5 vol. % of the hydrocarbon feed rate and was maintained for 20 hours only. This pushed introduction of water during the experiment led to an increase in catalyst activity with time. This increase in catalyst activity corresponds to ~30° F. reactor temperature. The operating conditions and conversion data for this run are shown in Table 1. The aging curve is shown in FIG. 2. The reactor temperature shown in the graph was corrected to yield a total liquid product (TLP) pour point of +30° F. using the assumed relationship of +1° F. reactor temperature = −2° F. of product pour point. It is clear from FIG. 2 that water injection improved catalyst activity and the reactor temperature required for 30° F. pour point liquid product was lowered by 30° F. Translating this temperature improvement to cycle life corresponds to an additional week in the length of the cycle. This pulsed water injection can be repeated and the catalyst life cycle can be extended.

TABLE 1

PROCESSING OF ALTAMONT CRUDE OVER PRESTEAMED NaZSM-5

| | | | | | | | | | | | | | | | | | | | | |
|---|---|---|---|---|---|---|---|---|---|---|---|---|---|---|---|---|---|---|---|---|
| Time on Stream (days) | | 1 | 1.5 | 2.5 | 5.3 | 6.1 | 6.9 | 7.9 | 8.9 | 12.9 | 13.9 | 14.9 | 16 | 19 | 20 | 20.7 | 22.5 | 25.5 | 27.5 | 28.2 |
| System Pressure (psig) | | 310 | 310 | 310 | 305 | 320 | 335 | 325 | 315 | 310 | 305 | 300 | 300 | 310 | 325 | 310 | 325 | 320 | 320 | 300 |
| Reaction Temp., °F. | | 650 | 700 | 700 | 700 | 700 | 700 | 710 | 710 | 710 | 710 | 710 | 720 | 720 | 720 | 720 | 730 | 730 | 730 | 740 |
| | | — | — | — | — | — | — | — | — | — | — | — | — | — | — | — | — | — | — | — |
| LHSV | | 0.9 | 0.87 | 0.6 | 1.24 | 1.18 | — | 1.12 | 1.00 | 0.65 | 1.11 | 0.89 | 1.22 | 1.10 | 1.16 | 1.09 | 1.12 | 1.11 | 0.81 | .7 |
| $H_2O$ Feed Rate cc/hrs | | — | — | — | — | — | — | — | — | — | — | — | — | — | — | 0.4 | — | — | — | — |
| Yield, Wt | | | | | | | | | | | | | | | | | | | | |
| Methane | | — | .01 | .02 | .01 | <.01 | — | .02 | .02 | .04 | — | — | .01 | .02 | .02 | .01 | .03 | .03 | .01 | .04 |
| Ethane | | — | .02 | .04 | .02 | .01 | — | .04 | .04 | .04 | — | — | .02 | .04 | .04 | .02 | .08 | .07 | .03 | .11 |
| Ethene | | — | .03 | .04 | .04 | .01 | — | .09 | .07 | .09 | — | — | .03 | .09 | .08 | .05 | .13 | .13 | .05 | .14 |
| Propane | | — | 1.15 | 1.98 | 1.11 | .44 | — | 1.73 | 1.76 | 1.52 | — | — | .06 | 1.59 | 1.50 | .99 | 2.17 | 1.82 | 1.03 | 2.60 |
| Propene | | — | .16 | .27 | .35 | .13 | — | .57 | .54 | .45 | — | — | .24 | .66 | .68 | .79 | .80 | .79 | .40 | .98 |
| Isobutane | | — | 1.21 | 2.15 | .83 | .45 | — | 1.19 | 1.36 | 1.24 | — | — | .40 | 1.12 | 1.01 | .58 | 2.06 | 1.11 | .81 | 1.85 |
| n-Butane | | — | 1.09 | 2.17 | .91 | .60 | — | 1.30 | 1.44 | 1.38 | — | — | .49 | 1.13 | 1.25 | .77 | 2.18 | 1.33 | 1.12 | 2.07 |
| 1-Butene | | — | .04 | .06 | .08 | .05 | — | .11 | .12 | .11 | — | — | .05 | 0.17 | 0.17 | 0.19 | .19 | .17 | .14 | .25 |
| Isobutene | | — | .16 | .33 | .35 | .21 | — | .51 | .57 | .50 | — | — | .24 | 0.66 | .70 | 0.73 | .77 | .66 | .54 | 1.00 |
| Trans-2-Butene | | — | .04 | .09 | .09 | .06 | — | .14 | .15 | .13 | — | — | .07 | .19 | 0.20 | 0.22 | .24 | .20 | .19 | .30 |
| Cis-2-Butene | | — | .04 | .09 | .09 | .06 | — | .14 | .15 | .13 | — | — | .07 | .19 | 0.20 | 0.22 | .24 | .20 | .19 | .30 |
| Total Gas ($C_4^-$) | Feed | — | 3.9 | 7.2 | 3.9 | 2.0 | — | 5.85 | 6.2 | 5.6 | — | — | 2.2 | 6.0 | 5.9 | 4.6 | 9.4 | 6.5 | 4.5 | 9.6 |
| $C_5$-330° F. | 6 | | | | 32.2 | | — | 36.2 | | 31.8 | — | — | — | 30.5 | — | — | 28.9 | 32.5 | — | — |
| 330° F.–800° F. | 45 | | | | 36.0 | | — | 34.0 | | 33.6 | — | — | — | 34.6 | — | — | 30.7 | 31.5 | — | — |
| 800° F.+ | 49 | | | | 28.8 | | — | 23.8 | | 29.0 | — | — | — | 28.9 | — | — | 31.0 | 29.5 | — | — |
| Pour Point, °F. | | | | | | | | | | | | | | | | | | | | |
| As drained (CRD) | | 90 | 15 | 15 | 30 | 45 | 45 | 30 | 30 | 20 | 45 | 40 | 50 | 45 | 65 | 85 | 20 | 35 | 40 | 35 |
| 330° F.–830° F. | | — | — | — | 25 | — | — | 15 | | −10 | — | — | — | 20 | — | — | −20 | 15 | — | — |
| 850° F.+ | | — | — | — | 120 | — | — | 120 | | 120 | — | — | — | 120 | — | — | 120 | 120 | — | — |
| Octane = $C_5$-330° F. | | — | — | — | 78.9 | — | — | 79.1 | | 80.4 | — | — | — | 81.6 | — | — | — | — | — | — |

EXAMPLE II

A presteamed Na ZSM-5 catalyst was prepared by contacting $NH_4ZSM$-5 extrude with 100% steam at 850° F. for 15 hours. As in Example 1, the steam treated product was treated with 1 N $NH_4NO_3$ and washed with de-ionized water. The resulting product was then nitrogen calcined at a rate of 1° C./min to 538° C. for 4 hours. As in Example 1, the nitrogen calcined catalyst was sodium exchanged to an alpha value of 0.3.

EXAMPLE III

Figure 3:
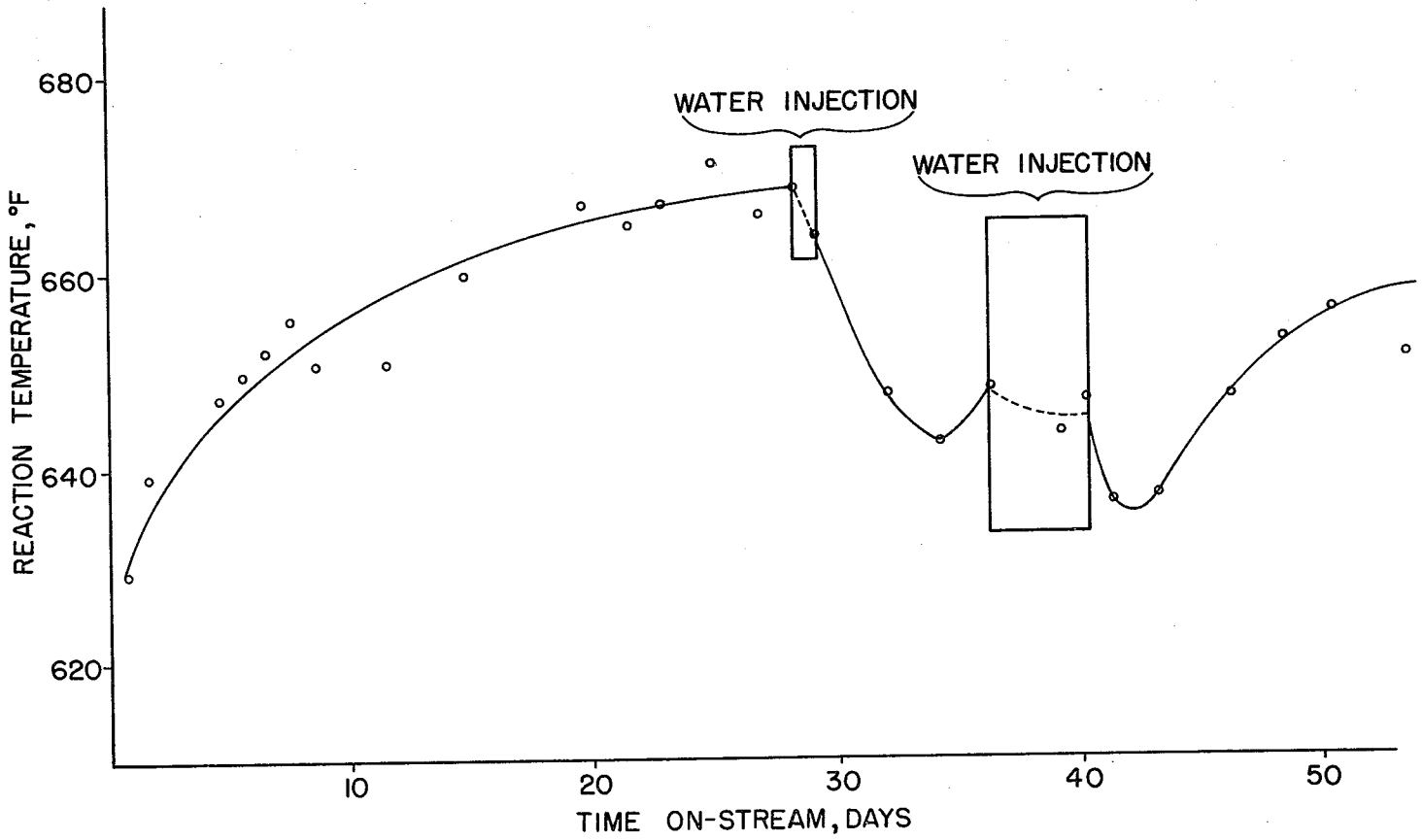
FIG. 3 is a graph showing the effect of water injection on reaction temperature when dewaxing Gippsland whole crude with presteamed Na ZSM-5 catalyst in the presence of added gas.

A continuous run of 53 days was used to process Gippsland whole crude over the catalyst of Example II in the presence of added methane. The operating conditions and conversion data for this run are summarized in Table 2. Gippsland crude, pour point 60° F., was readily dewaxed over presteamed NaZSM-5 in the presence of added methane flow. Pour points of TLP ranged from −85° to −25° F. The aging curve and the effect of water injection is shown in FIG. 3, where the reaction temperature has been normalized to a total liquid product pour point of −40° F. Cofeeding water at a rate of 5 vol % of the hydrocarbon feed increased catalyst activity. This increased activity lasted even after the termination of the water injection. The effect of water is reversible as shown in FIG. 3. The promotional effect of water reached a maximum and this maximum roughly corresponded to the beginning of the starting cycle. Soon after catalyst activation, the catalyst behaved as if it were a fresh catalyst.

TABLE 2

PROCESSING OF GIPPSLAND CRUDE OVER PRESTEAMED NAZSM-5

| | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|
| Time on Stream (days) | | 0.9 | 1.8 | 4.8 | 5.8 | 6.7 | 7.7 | 8.7 | 11.7 | 14.8 | 19.6 | 21.6 | 22.9 | 25 | 26.8 | 28 | 29 | 32 | 34.1 | 36 | 39 | 40 | 41 | 43 | 46 | 48.1 | 50.1 | 53 |
| System Pressure (psig) | | 300 | 300 | 300 | 300 | 300 | 300 | 300 | 300 | 300 | 300 | 300 | 300 | 300 | 300 | 300 | 300 | 300 | 295 | 300 | 300 | 300 | 300 | 300 | 320 | 320 | 320 | 320 |
| Reaction Temp. °F. | | 650 | 650 | 650 | 650 | 650 | 650 | 650 | 650 | 662 | 662 | 662 | 662 | 662 | 670 | 670 | 670 | 670 | 650 | 650 | 650 | 650 | 650 | 630 | 640 | 650 | 650 | 650 |
| $CH_4$ rate, cc/min. | | 23 | 23 | 23 | 23 | 23 | 23 | 23 | 23 | 23 | 23 | 23 | 23 | 23 | 23 | 23 | 23 | 23 | 23 | 23 | 23 | 23 | 23 | 23 | 23 | 23 | 23 | 23 |
| LHSV | | 0.94 | 1.10 | 1.08 | 1.00 | 0.99 | — | 1.04 | .87 | .84 | .85 | .84 | .76 | .89 | .87 | .88 | .88 | .86 | .87 | .84 | .87 | .87 | .87 | .86 | .87 | .87 | .87 | .89 |
| $H_2O$ Rate cc/hr | | — | — | — | — | — | — | — | — | — | — | — | — | — | — | — | 0.3 | — | — | — | 0.3 | 0.3 | — | — | — | — | — | — |
| Yield, wt. | | | | | | | | | | | | | | | | | | | | | | | | | | | | |
| Methane | | — | — | — | — | — | — | — | — | — | — | — | — | — | — | — | — | — | .08 | .08 | .08 | .08 | .06 | .08 | .08 | .07 | .07 | .07 |
| Ethane | | .12 | .10 | .14 | .11 | .11 | .14 | .10 | .12 | .11 | .13 | .08 | .08 | .08 | .08 | .08 | .06 | .09 | .06 | .05 | .06 | .07 | .05 | .03 | .04 | .04 | .04 | .03 |
| Ethene | | .07 | .05 | .06 | .05 | .05 | .04 | .04 | .04 | .05 | .04 | .03 | .04 | .04 | .05 | .05 | .07 | .10 | .99 | .98 | 1.03 | 1.06 | .78 | .66 | .76 | .78 | .75 | .66 |
| Propane | | 1.29 | 1.03 | 1.06 | .90 | .87 | .98 | .75 | .84 | .85 | .83 | .73 | .79 | .81 | 1.00 | .96 | 1.15 | 1.32 | .69 | .69 | .58 | .60 | .48 | .45 | .52 | .54 | .54 | .51 |
| Propene | | .50 | .51 | .68 | .62 | .62 | .68 | .51 | .62 | .65 | .73 | .65 | .66 | .74 | .79 | .76 | .47 | .76 | .82 | .81 | 1.03 | 1.00 | .71 | .53 | .60 | .61 | .58 | .49 |
| Isobutane | | 1.52 | 1.03 | .84 | .75 | .71 | .81 | .63 | .62 | .65 | .61 | .52 | .61 | .58 | .80 | .77 | 1.25 | 1.22 | 2.17 | 2.21 | 2.27 | 2.14 | 1.61 | 1.67 | 1.82 | 1.80 | 1.78 | 1.55 |
| n-Butane | | 2.71 | 2.25 | 1.91 | 2.05 | 1.99 | 2.44 | 1.73 | 1.68 | 1.70 | 1.84 | 1.54 | 1.85 | 1.78 | 2.17 | 2.08 | 2.16 | 2.44 | .23 | .23 | .19 | .18 | .14 | .14 | .19 | .18 | .19 | .17 |
| 1-Butene | | .16 | .13 | .16 | .20 | .21 | .21 | .17 | .19 | .21 | .23 | .21 | .21 | .23 | .25 | .25 | .15 | .24 | 1.05 | 1.06 | .90 | .86 | .72 | .73 | .80 | .85 | .83 | .72 |
| Isobutene | | 2.64 | 2.16 | 1.40 | .90 | .90 | .81 | .78 | .79 | .87 | .98 | .88 | .91 | 1.00 | 1.14 | 1.07 | .68 | 1.02 | .62 | .64 | .51 | .48 | .46 | .53 | .54 | .55 | .54 | .48 |
| Trans-2-Butene | | .51 | .49 | .41 | .63 | .56 | .56 | .49 | .43 | .46 | .62 | .54 | .56 | .62 | .67 | .65 | .40 | .63 | .42 | .44 | .34 | .32 | .28 | .32 | .33 | .34 | .33 | .29 |
| Cis-2-Butene | | .31 | .31 | .25 | .39 | .38 | .38 | .33 | .29 | .31 | .42 | .36 | .38 | .42 | .45 | .44 | .27 | .38 | .42 | .44 | .34 | .32 | .28 | .32 | .33 | .34 | .33 | .29 |
| | Feed | | | | | | | | | | | | | | | | | | | | | | | | | | | |
| Total Gas ($C_4$) | | 9.8 | 8.1 | 6.9 | 6.6 | 6.4 | 7.1 | 5.5 | 5.6 | 5.9 | 6.4 | 5.6 | 6.1 | 6.3 | 7.4 | 7.1 | 6.7 | 8.2 | 7.1 | 7.2 | 7.0 | 6.8 | 5.3 | 5.1 | 5.7 | 5.8 | 5.6 | 5.0 |
| $C_5$-330° F. (est) | 37 | 48.5 | 48.1 | 41.5 | 45.6 | 51.8 | 46.9 | 51.4 | 49.7 | 49.0 | 51.6 | 49.5 | 48.4 | 46.1 | 50.5 | 56.9 | 48.3 | 60.8 | 50.5 | 52.2 | 46.6 | 52.2 | 47.2 | 44.6 | 44.5 | | | |
| 330–800° F. (est) | 53 | 35.6 | 35.7 | 43.2 | 40.8 | 35.2 | 38.7 | 35.8 | 42.3 | 40.5 | 38.3 | 37.6 | 38.7 | 41.5 | 37.1 | 31.8 | 37.8 | 27.6 | 36.7 | 36.5 | 38.7 | 34.8 | 36.2 | 39.48 | 41.4 | | | |
| 800° F.+- (est) | 10 | 6.1 | 8.1 | 8.3 | 7.0 | 6.6 | 7.3 | 7.3 | 2.4 | 4.6 | 3.7 | 7.3 | 6.8 | 6.1 | 5.0 | 4.1 | 7.2 | 3.4 | 5.7 | 4.1 | 6.7 | 5.9 | 11.3 | 10.8 | 8.4 | | | |
| Pour point, °F. | | | | | | | | | | | | | | | | | | | | | | | | | | | | |
| As drained | 60 | −85 | −65 | −45 | −40 | −30 | −30 | −40 | −40 | −45 | −35 | −35 | −35 | −25 | −50 | −45 | −55 | −85 | −55 | −45 | −55 | −50 | −70 | −30 | −30 | −35 | −30 | −40 |
| 330–800° F. | 65 | | | −15 | | | | | −5 | | | | | | | | | | | | | | | | | | | |
| 830° F.+ | 110 | | | | | | | | 70 | | | | | | | | | | | | | | | | | | | |
| Octane $C_5$-330° F. | 60 | | | | 68.8 | | | | | | | | | | | | | | | | | | | | | | | |

EXAMPLE IV

Figure 4:
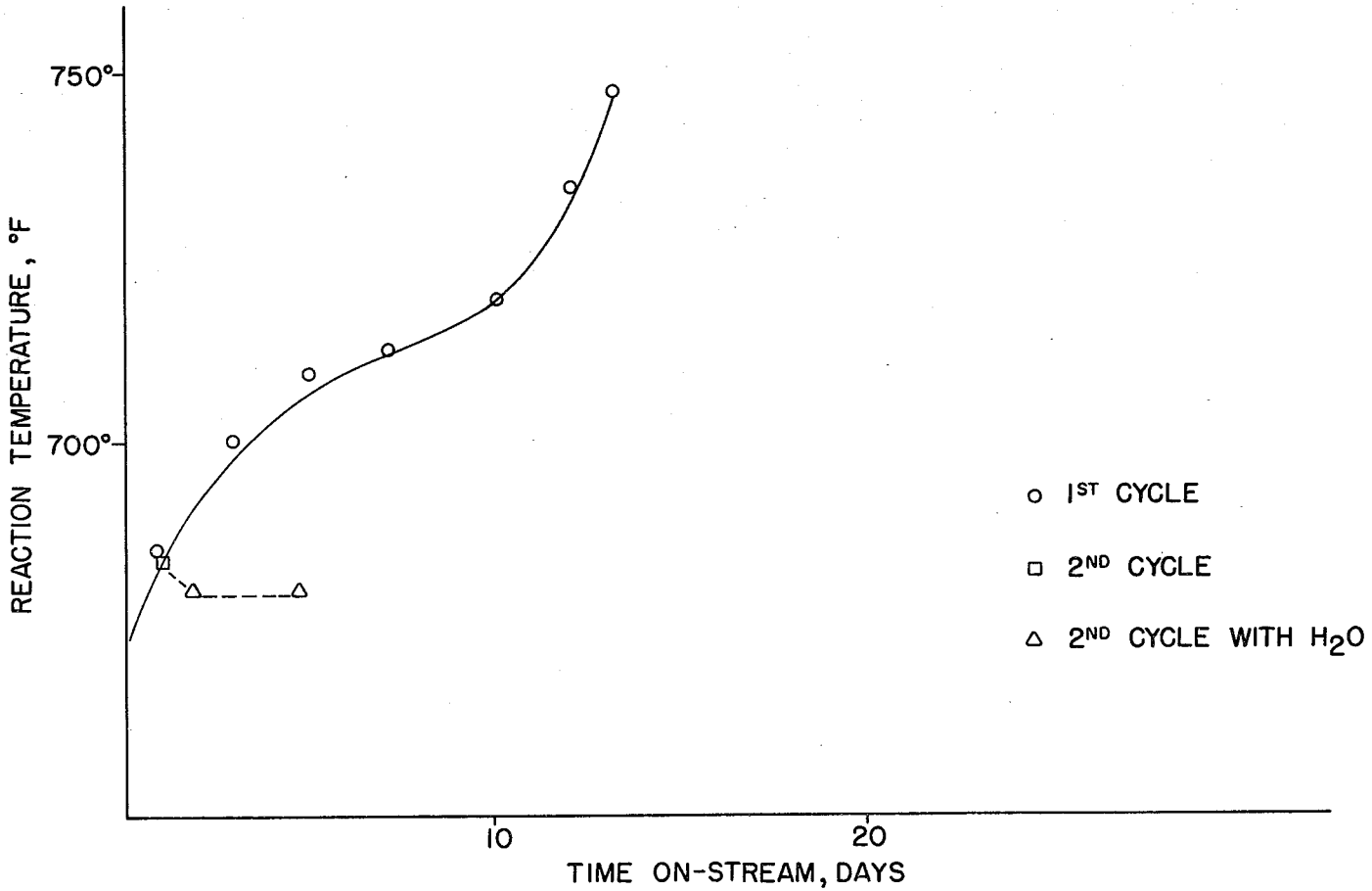
FIG. 4 is a graph showing the effect of water injection on reaction temperature when dewaxing topped Minas crude with presteamed Na ZSM-5 catalyst in the presence of added gas.

A 650° F.+ boiling point fraction of Minas crude, pour point of 115° F., was processed over the catalyst of Example II. The feed was passed over the catalyst at temperatures of 680°–730° F., 0.9 LHSV and in the presence of added methane. A dewaxed liquid product with 60° F. pour point was obtained over a cycle length of 10 days. At the conclusion of the first cycle, the catalyst was air regenerated and a second pre-topped Minas crude cycle was begun. The results of the first day of the second cycle with the regenerated catalyst were identical to the first cycle results obtained with the fresh catalyst. After the first day water was cofed at a rate of 3–5 vol% of the hydrocarbon feed rate, an enhanced state of dewaxing activity was maintained at 0.8 LHSV for the pre-topped crude. The operating conditions and results are shown in Table 3 and FIG. 4 where the reaction temperature has been normalized to a TLP pour point of +60° F. FIG. 4 shows that the benefits of water injection observed in Examples I and III are obtained with a regenerated catalyst even though water injection was not employed in the first cycle of the fresh presteamed Na ZSM-5 catalyst.

TABLE 3

PROCESSING OF PRETOPPED MINAS CRUDE OVER PRESTEAMED NaZSM-5

| | | First Cycle | | | | | | | | | | | | | Second Cycle | | |
|---|---|---|---|---|---|---|---|---|---|---|---|---|---|---|---|---|---|
| Time on Stream (days) | | 0.9 | 2.9 | 5 | 7.1 | 10 | 12 | 13 | 14 | 17 | 18 | 19 | 20 | | 1 | 1.9 | 4.9 |
| System Pressure (psig) | | 340 | 340 | 340 | 340 | 345 | 350 | 350 | 340 | 340 | 300–340 | 300–340 | 300–340 | AIR | 320 | 330 | 650 |
| Reaction Temp. °F. | | 690 | 700 | 710 | 710 | 710 | 720 | 730 | 730 | 730 | 730 | 730 | 740 | | 690 | 690 | 690 |
| $CH_4$ rate, cc/hr | | 28 | 19 | 19 | 19 | 19 | 19 | 19 | 19 | 19 | 19 | 19 | 19 | R | 19 | 19 | 19 |
| LHSV | | .81 | .83 | .82 | .79 | .80 | .80 | .77 | .79 | .80 | .80 | .80 | .75 | E | .82 | .77 | .67 |
| $H_2O$ Rate cc/hr | | — | — | — | — | — | — | — | .3 | .3 | .3 | — | — | G | — | .3 | .15 |
| Yield, wt. | | | | | | | | | | | | | | E | | | |
| Methane | | — | — | — | — | — | — | — | — | — | — | — | — | N | — | — | — |
| Ethane | | .07 | .11 | .10 | .10 | .09 | .09 | .10 | .10 | .07 | .11 | .11 | .12 | E | .09 | .09 | .09 |
| Ethene | | .08 | .13 | .11 | .08 | .06 | .03 | .03 | .03 | .02 | .03 | .03 | .03 | R | .11 | .10 | .09 |
| Propane | | .85 | 1.50 | 1.33 | 1.08 | .80 | .35 | .37 | .31 | .17 | .28 | .33 | .30 | A | 1.60 | 1.24 | 1.20 |
| Propene | | .53 | 1.04 | 1.06 | .99 | .89 | .41 | .26 | .38 | .16 | .17 | .15 | .12 | T | .72 | .85 | 1.06 |
| Isobutane | | 1.13 | 1.61 | 1.31 | .94 | .60 | .24 | .30 | .23 | .11 | .20 | .21 | .16 | I | 1.98 | 1.52 | 1.24 |
| N-Butane | | 1.20 | 1.98 | 1.78 | 1.38 | .98 | .40 | .42 | .31 | .16 | .24 | .25 | .20 | O | 2.11 | 1.65 | 1.63 |
| 1-Butene | | .18 | .34 | .37 | .34 | .32 | .14 | .09 | .11 | .05 | .05 | .05 | .03 | N | .24 | .28 | .38 |
| Isobutene | | .72 | 1.41 | 1.42 | 1.21 | .98 | .43 | .31 | .34 | .17 | .18 | .16 | .12 | | .96 | 1.11 | 1.37 |
| Trans-2-Butene | | .37 | .71 | .83 | .73 | .65 | .29 | .20 | .23 | .11 | .10 | .09 | .06 | | .51 | .61 | .85 |
| Cis-2-Butene | | .25 | .48 | .56 | .49 | .44 | .20 | .14 | .16 | .07 | .07 | .06 | .04 | | .34 | .41 | .52 |
| | Feed | | | | | | | | | | | | | | | | |
| Total Gas ($C_4$) | | 5.4 | 9.3 | 8.9 | 7.4 | 5.8 | 2.6 | 2.2 | 2.2 | 1.1 | 1.4 | 1.4 | 1.2 | | 8.7 | 7.8 | 8.4 |
| $C_5$-330° F. | | | | | | | | | | | | | | | | | |
| 330° F.–800° F. | | | | | | | | | | | | | | | | | |
| 800° F.+ | | | | | | | | | | | | | | | | | |
| $C_5$-650° F. | | | 23.6 | | | | | | | | | | | | | | |
| 650° F.+ | 100 | | 67.1 | | | | | | | | | | | | | | |
| Pour point °F. | | | | | | | | | | | | | | | | | |
| As drained | 115 | 50 | 60 | 60 | 65 | 80 | 90 | 95 | 105 | — | — | 105 | 110 | | 50 | 40 | 40 |

What is claimed is:

1. A process for reducing the pour point of a was containing mineral oil to a predetermined value which comprises:

contacting a mixture of said mineral oil and added water or a water precursor with a catalyst having an alpha value less than about 10, in the presence or absence of added gas, under conversion conditions effective to reduce the pour point of said oil to said predetermined value, said catalyst having been prepared from a composition comprising a precursor crystalline aluminosilicate having a silica-alumina ratio greater than 12, a constraint index between about 1 and about 12 and an alpha value greater than about 20, said preparation including steaming said precursor to reduce its alpha value to not less than about 10 and ion-exchanging said steamed precursor with an alkali metal cation under conditions effective to further reduce its alpha value to less than about 10, said water or said water precursor being present in an amount effective to reduce the conversion temperature required to effect the reduction of the pour point of said mineral oil to said predetermined value in the absence of said water or said water precursor.

2. A process according to claim 1 wherein said precursor crystalline aluminosilicate is ZSM-5 zeolite in hydrogen or ammonium form.

3. A process according to claim 1 wherein said catalyst has an alpha value less than about 1.

4. A process according to claim 1 wherein said alkali metal cation is sodium.

5. A process according to claim 1 wherein said alkali metal cation is lithium.

6. A process according to claim 1 wherein the pour point reduction is conducted in the presence of added gas.

7. A process according to claim 6 wherein the gas addition is 0 to 15,000 scf/bbl.

8. A process according to claim 6 wherein the added gas comprises hydrogen, $C_1$–$C_3$ hydrocarbon or mixtures thereof.

9. A process according to claim 8 wherein the added gas comprises hydrogen.

10. A process according to claim 8 wherein the added gas comprises methane.

11. A process according to claim 1 wherein the wax-containing mineral oil is whole crude, reduced crude or gas oil.

12. A process according to claim 1 wherein the water or water precursor is periodically admixed with the mineral oil and the effective amount, based on water, is between about 0.01 and about 30 volumes of water per volume of catalyst.

13. A process according to claim 1 wherein the water or water precursor is continuously admixed with the mineral oil and the effective amount, based on water, is less than about 5 volume percent of said mineral oil.

* * * * *

UNITED STATES PATENT AND TRADEMARK OFFICE

CERTIFICATE OF CORRECTION

PATENT NO. : 4,377,469

DATED : March 22, 1983

INVENTOR(S) : David S. Shihabi

It is certified that error appears in the above-identified patent and that said Letters Patent is hereby corrected as shown below:

Column 2 line 49 - "hydrowaxing" should be --hydrodewaxing--.

Table 2 column 17 - at heading 34.1 - 53 specification has no numbers for "Cis-2-Butene". The numbers printed in the patent were duplicated from heading 34.1 - 53 "Trans-2-Butene".

Signed and Sealed this

*Tenth* Day of *July 1984*

[SEAL]

*Attest:*

GERALD J. MOSSINGHOFF

*Attesting Officer*

*Commissioner of Patents and Trademarks*